US008183481B2

(12) United States Patent
Zinchuk et al.

(10) Patent No.: US 8,183,481 B2
(45) Date of Patent: May 22, 2012

(54) MECHANICAL INTERLOCK OF A LEVER OPERATED RECEPTACLE WITH A SHAFT OPERATED SWITCH

(75) Inventors: Tom Zinchuk, Temecula, CA (US); David Hellmers, Carlsbad, CA (US)

(73) Assignee: ESL Power Systems, Inc., Corona, CA (US)

( * ) Notice: Subject to any disclaimer, the term of this patent is extended or adjusted under 35 U.S.C. 154(b) by 283 days.

(21) Appl. No.: 12/711,504

(22) Filed: Feb. 24, 2010

(65) Prior Publication Data

US 2011/0203908 A1 Aug. 25, 2011

(51) Int. Cl.
*H01H 9/20* (2006.01)

(52) U.S. Cl. ..... 200/50.3; 200/50.28

(58) Field of Classification Search .... 200/50.28–50.31, 200/50.33

See application file for complete search history.

(56) References Cited

U.S. PATENT DOCUMENTS

| | | | | |
|---|---|---|---|---|
| 4,553,000 | A * | 11/1985 | Appleton | 200/50.29 |
| 5,298,701 | A * | 3/1994 | Sandor | 200/50.31 |
| 6,255,607 | B1 * | 7/2001 | Miller | 200/50.29 |
| 6,448,515 | B1 * | 9/2002 | Rohmer et al. | 200/50.28 |

* cited by examiner

*Primary Examiner* — Xuong Chung Trans
(74) *Attorney, Agent, or Firm* — Rosenberg, Klein & Lee

(57) ABSTRACT

A mechanical interlock of a lever operated receptacle with a shaft operated switch is disclosed and provides mechanically interlocked electrical service to cord-connected equipment such as wheeled gantries, vehicles docked at port terminals, heavy manufacturing, and mining equipment. The power transmission safety system locks a plug into a receptacle until a main power switch has been disengaged and a grounding switch has been engaged. Only if the receptacle is switched off and grounded will the receptacle allow a plug to be inserted. The power transmission safety system is mechanically prohibited from being engaged or ungrounded until a plug has been inserted into the receptacle and locked into place. To again unlock and remove the plug from the receptacle, the power transmission safety system must be deactivated and grounded.

20 Claims, 12 Drawing Sheets

MECHANICAL INTERLOCK OF A LEVER OPERATED RECEPTACLE WITH A SHAFT OPERATED SWITCH

BACKGROUND OF THE INVENTION

1. Field of the Invention

The present invention is generally directed to an apparatus and a method for providing a mechanical interlock of a lever operated receptacle with a shaft operated switch. More specifically, a mechanically interlocked ground switch, main power switch, receptacle, and receptacle handle lever prevents energizing the receptacle or disconnecting the ground switch without the plug being inserted and locked into the receptacle. Further, the unlocking or disengaging of the plug while the switch is on and ungrounded is mechanically and reliably prevented. In other words the power switch cannot be turned on without a properly inserted plug and the plug cannot then be removed with the switch remaining in the on position.

2. Prior Art

Interlock systems of other lever operated receptacles in use in modern electrical systems may employ an electrically interlocked system using logic to disallow potentially dangerous or undesirable conditions. However, if the electrical system fails for any reason, the electrical interlock system would also fail—potentially resulting in casualty or damage to powered systems.

Another strategy is to use a key interlock system where a key is used to restrict access to and limit potential states of the system. However this faces the drawbacks of heightened expense, complicated key logistics, key access accounting, access control, and secure storage balanced with accessibility. If a key should be lost, the system is rendered inoperative until a replacement key can be identified and procured. In an emergency situation, this can result in catastrophic losses and delay costs brought about by lost productivity, late deliveries, missed deadlines, locksmiths, as well as key administration costs.

More importantly, the system is able to be undermined through the use of duplicate keys or neglecting to re-lock the systems appropriately. Such a system is entirely dependent on users remembering and choosing to relock the system each and every time.

Another conventional means to ensure proper operation of an electrical receptacle and switch is operator training. Operators are simply trained to perform operations in a specified sequence so as to reduce harm to components and personnel. However, this is difficult to enforce and exposes personnel and hardware to great risks should the procedures not be followed correctly. Again, such a system is entirely dependent upon voluntary compliance each and every time by users.

Thus, one problem associated with conventional power switches and receptacles is the exposure of technicians or ordinary users to potentially dangerous and even life threatening situations where interlock systems are susceptible to failure and lack assured enforcement of safety procedures. Such systems are easily undermined, omitted, or broken.

Yet another problem associated with conventional power switches is the ease with which one can overcome the previous protection schemes either maliciously, through laziness, or improper user/technician education.

SUMMARY OF THE INVENTION

An enclosure is provided in which is contained a main power switch and a ground switch. Each of the main power switch and the ground switch are coupled to a respective actuating shaft. The two shafts are disposed in a substantially parallel arrangement. The enclosure has at least one access door which, when opened, provides access to two through holes through at least one obstructive member that blocks the operating shafts of the inner switches and the interlocks. Initially, these two through holes are at least partially occluded by two large disks or another movable obstructive member or assembly.

On an outer face of the enclosure a receptacle is provided which is operable to receive an electric plug. The electric plug is preferably a medium voltage push-and-pull-type plug connector for providing power to ships, gantries, or other machinery which requires a connection to provided power. When the electric plug is inserted into the receptacle a first push rod protruding into or around the plug receptacle is displaced. This first push rod is coupled to one of the two disks. The push rod receives a linear force from the insertion of the plug into the receptacle and transmits it to an off-center portion of a first disk which converts the linear force into to a torquing or torquative rotary force which angularly displaces the receiving disk. Through holes are provided through the disk, and through the angular displacement of the disk, these through-holes are brought into registration with two through holes provided on the enclosure.

Next, when the plug is locked into the receptacle, a handle lever on the outside of the plug receptacle is engaged into a locked position; this locking rotates a rammed portion of the handle lever to impart another linear displacing force on a second push rod. This second push rod itself transmits another linear force to a second disk. An off-center portion of the second disk receives the displacement of the second push-rod and converts this to a torquative or rotary force acting to angularly displace the second disk contained in the enclosure. The second disk also contains two through-holes that are brought into registration with the through-holes of the first disk and preferably the through-holes of an obstructive member of the enclosure when the second disk is angularly displaced.

Therefore, in a preferred embodiment, when the plug is inserted and the plug is locked, both the first and second disks are rotated such that two through holes contained in each disk are brought into registration with two through holes contained on the obstructive member of the enclosure. This registration of each respective through-hole provides access through the through-holes to the two shafts which are each respectively coupled to the ground switch and the main power switch.

When the plug is inserted and locked, the user is now able to unground the connection and then make the main power connection, or transition the main power connection into an on position.

These two shafts contained in the enclosure may be operably coupled together through a power interlock bar. The ends of the two shafts where the power interlock bar is coupled may have different cross-sectional diameters and cammed or ramped transitional portions. These differing cross-sectional diameters may act as a cam where a rotational displacement causes the radius of the shaft to increase and laterally displace the power interlock bar. When the first shaft is rotated to an "ON" position, an increasing cross-sectional radius impinges on the power interlock bar, thus displacing it laterally to a furthest lateral extreme. As this power interlock bar has been displaced laterally to a maximum extent in one direction, this prevents the other shaft from being rotated to an "ON" position as the second shaft's cam structure prohibits rotation due to the inelasticity of the power interlock bar and tolerances which have been minimized.

While the grounding switch is in the "OFF" position, the receptacle handle lever is prohibited from being actuated. The grounding switch is operably coupled through a ground switch linkage to a large gate wheel. This ground switch linkage can be coupled to the grounding switch itself, an arm/blade thereof, or directly to the grounding switch operating shaft. When the grounding switch operating shaft is rotated into an "OFF" position, a rotary movement of the grounding switch operating shaft imparts a linear displacement on the ground switch linkage which is pivotally coupled to the large gate wheel and imparts a rotational movement thereto. A small gate wheel is fixedly coupled through a shaft to the large gate wheel. The small gate wheel therefore mirrors the angular displacement of the large gate wheel. The small gate wheel may then be pivotally coupled to a ground gate member. Thereby, when the small gate wheel rotates the ground gate member is displaced in an upward or downward linear motion responsive thereto. When the grounding switch is engaged, or in the "ON" position, the ground gate member is raised to its highest point of travel.

Conversely, when the grounding switch is "OFF", the grounding gate member is displaced to its lowest point of travel. In the lowest point of travel, the grounding gate occludes or restricts the travel of a locking push rod. The locking push rod is preferably biased to a distal position (outwards) through the use of a resilient member which could be a spring. However, the resilient member is able to be overcome by actuation of the receptacle lever when not locked. In contradistinction, when the lever receptacle is actuated a cam-like structure of the receptacle handle lever imparts a force, thereby achieving a displacement on the locking push rod towards the ground gate. In the event the ground switch is engaged the locking push rod travels freely or elastically.

However, in the event that the grounding switch is ungrounded, or in the "OFF" position, the ground gate, being in its lowest travel, blocks or restricts the free movement of the locking push rod. Inasmuch as the locking push rod is arrested and cannot travel to its furthest extent, the lever receptacle is also restricted from travelling.

Thereby a user is unable to remove or unlock the plug until the switch member is regrounded. Further, as the two switch members are mutually exclusive through the use of the mechanical power interlock bar, the main power switch must first be disengaged, and only then will the grounding switch be able to be engaged. Once the grounding switch has been engaged, and only then, is a user able to unlock and remove the plug member.

DESCRIPTION OF THE PREFERRED EMBODIMENTS

Figure 1:
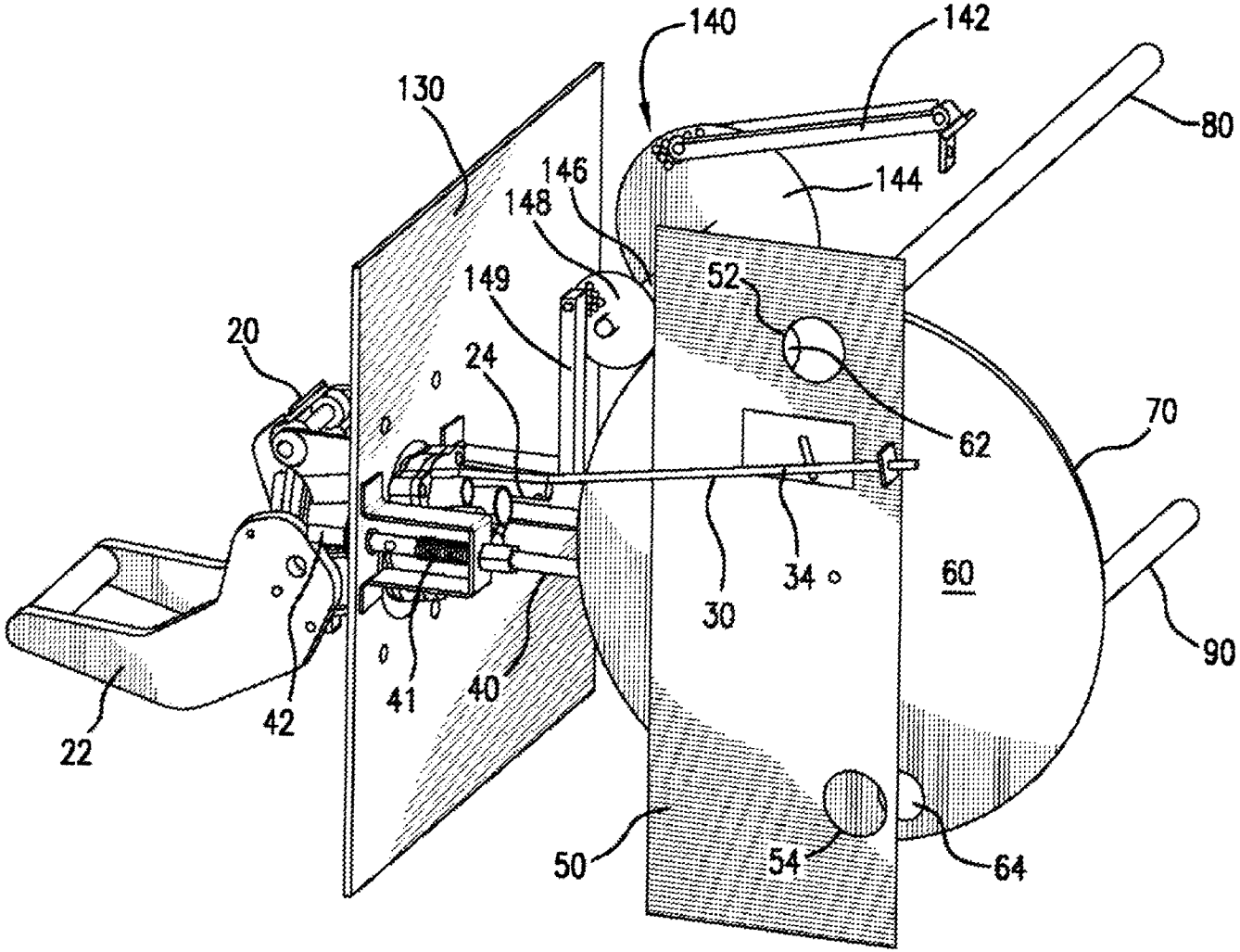
FIG. 1 is a perspective drawing of an interlock assembly to be used internal to the enclosure.

Referring to FIG. 1, there is shown a mechanical interlock of a lever operated receptacle with a shaft operated switch. The mechanical interlock of a lever operated receptacle with a shaft operated switch includes a receptacle 20 for receiving a plug and having a pivotally coupled handle lever 22. A first obstructive enclosure 130 or cabinet shields the internal workings of the interlocking switch assembly from a user—ensuring the user's safety and the integrity of the internal workings. A first shaft 80 is arranged in parallel relation to a second shaft 90. Each of the first shaft 80 and second shaft 90 will be respectively coupled to a grounding switch and a main power switch. Initially, while the receptacle is not locked and no plug is inserted, access to the first shaft 80 and the second shaft 90 are obstructed by both an outer disk 60 and an inner disk 70. Outer disk 60 has two through holes 62 and 64 which are disposed on opposite sides of a central portion of outer disk 60, substantially the same distance as the distance between the first shaft 80 and second shaft 90. Inner disk 70 has two through holes (72 and 74) as well, arranged analogously to the through holes of the outer disk 60.

Initially, when both the handle lever 22 is unlocked and the receptacle is empty (no plug is inserted), the through holes of inner disk 70 and outer disk 60 are preferably unregistered with the through holes 52 and 54 of an obstructive element 50 thereby occluding passage through through-holes 52 and 54 of the obstructive element 50. The unregistered state of n disk 70 and outer disk 60 blocks access to shafts 80 and 90.

Receptacle 20 has a protective element, preferably a lid that shields off the receptacle. When lever handle 22 is actuated, this protective element shielding the receptacle 20 is opened to allow insertion of a plug. When the plug is inserted, the leading edge of the housing of the plug actuates a plug push rod 30 which protrudes into the receptacle from within the enclosure 130. The plug's insertion occasions a linear displacement on push rod 30 which is coupled to an orthogonal disk engaging member which pivotally engages an off-center portion of the outer disk 60. Thereby, the linear displacement of the plug push rod 30 creates a torquative or rotary force on the outer disk 60 through a disk engaging portion 34 of push rod 30. This rotary or torquative force results in a rotational movement of outer disk 60 which brings through-holes 62 and 64 into registration with the though-holes 52 and 54 of the obstructive element 50.

The user then clamps down the lever handle 22 thereby locking the plug into the receptacle 20. This locking action imparts a linear force on the receptacle push rod 40 which is initially biased outwards through a resilient spring-type member 41. When receptacle push rod 40 is actuated, the linear displacement imparts a rotational movement to the inner disk 70 through means similar to the movement of the outer disk 60. Inner disk 70 similarly has two through-holes that are also brought into registration with the outer disk through-holes 62, 64 and the obstructive element 50's through holes 52 and 54. Thereby, once the plug is inserted and the lever handle 22 is locked, all three pairs of through holes (52,54; 62,64; and 72,74) are brought into respective registration (e.g. through hole 52 aligns with 62 and 72) thereby allowing full access to the two shaft members 80 and 90.

The user may then access first shaft 80 through through holes 52, 62, and 72 and rotationally engage the shaft 80 which will impart a rotational force on the grounding member to deactivate the ground, or switch the ground to an "OFF" position. The deactivation of the grounding switch will cause the ground switch linkage 142 to travel linearly which imparts a rotational movement to the large gate wheel 144 of grounding safety lock assembly 140, which in turn, through a coupling member 146, rotates the small gate wheel 148. The small gate wheel 148 in rotating counterclockwise imparts a linear downward motion to the ground gate 149. The ground gate member 149 will come to rest in the travel path of a locking push rod 24. The grounding gate member 149 thereby restricts the travel of the locking push rod 24 which thereby prevents the lever handle 22 from becoming disengaged either accidentally or through user intervention. Inasmuch as the lever handle 22 cannot be disengaged the plug cannot be disengaged. Indeed, the plug cannot be unlocked or disengaged until both the main power has been shut off and the grounding switch has been reactivated.

Figure 2:
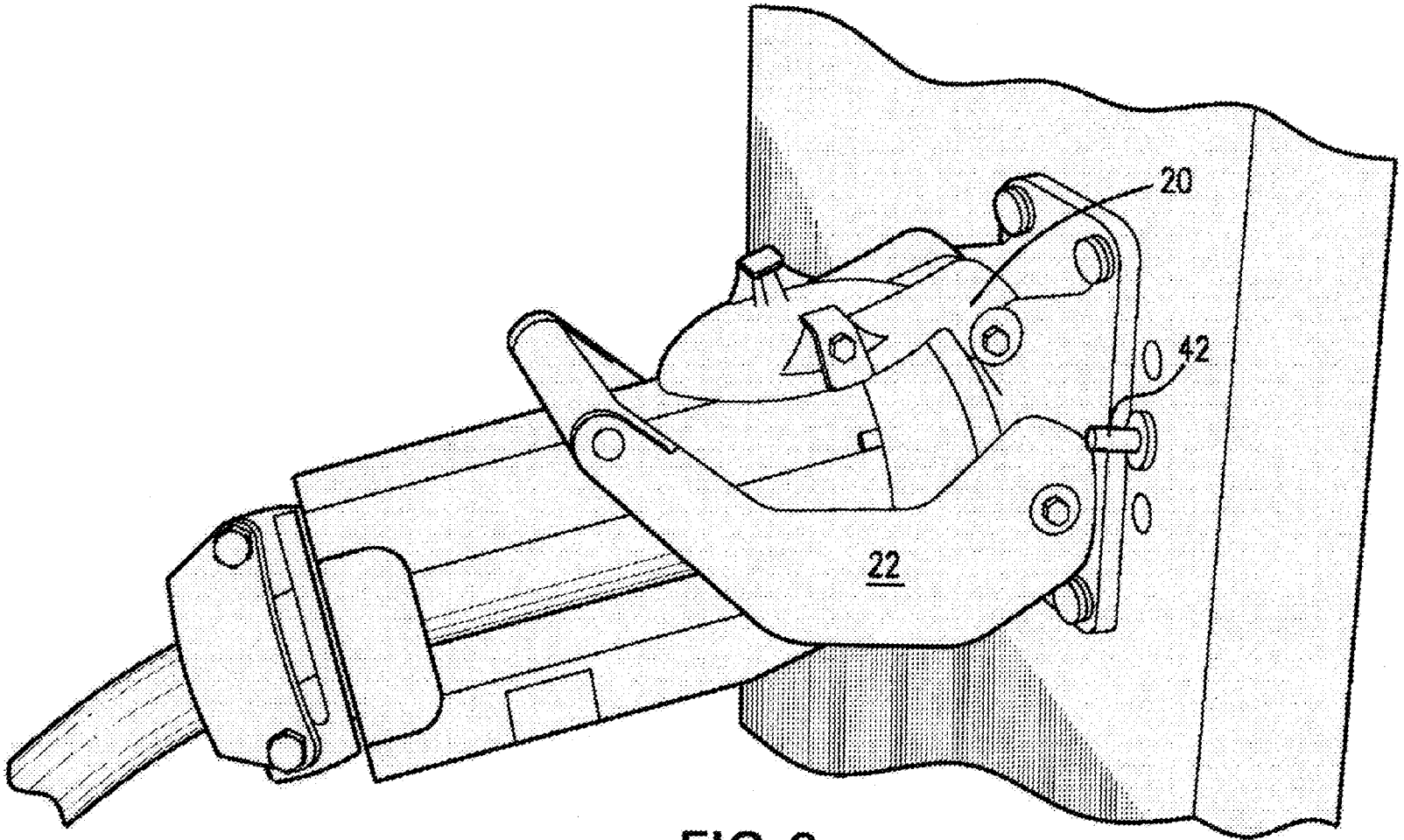
FIG. 2 is a perspective view of a lever operated receptacle and plug.

FIG. 2 shows a plug inserted into receptacle 20, the lever handle 22 of the receptacle 20, and an engaging portion 42 of receptacle push rod 40. Locking push rod 24 (not shown) is arranged substantially symmetrically to push rod 40, on the opposite side of the lever handle 22 (far side).

Figure 3:
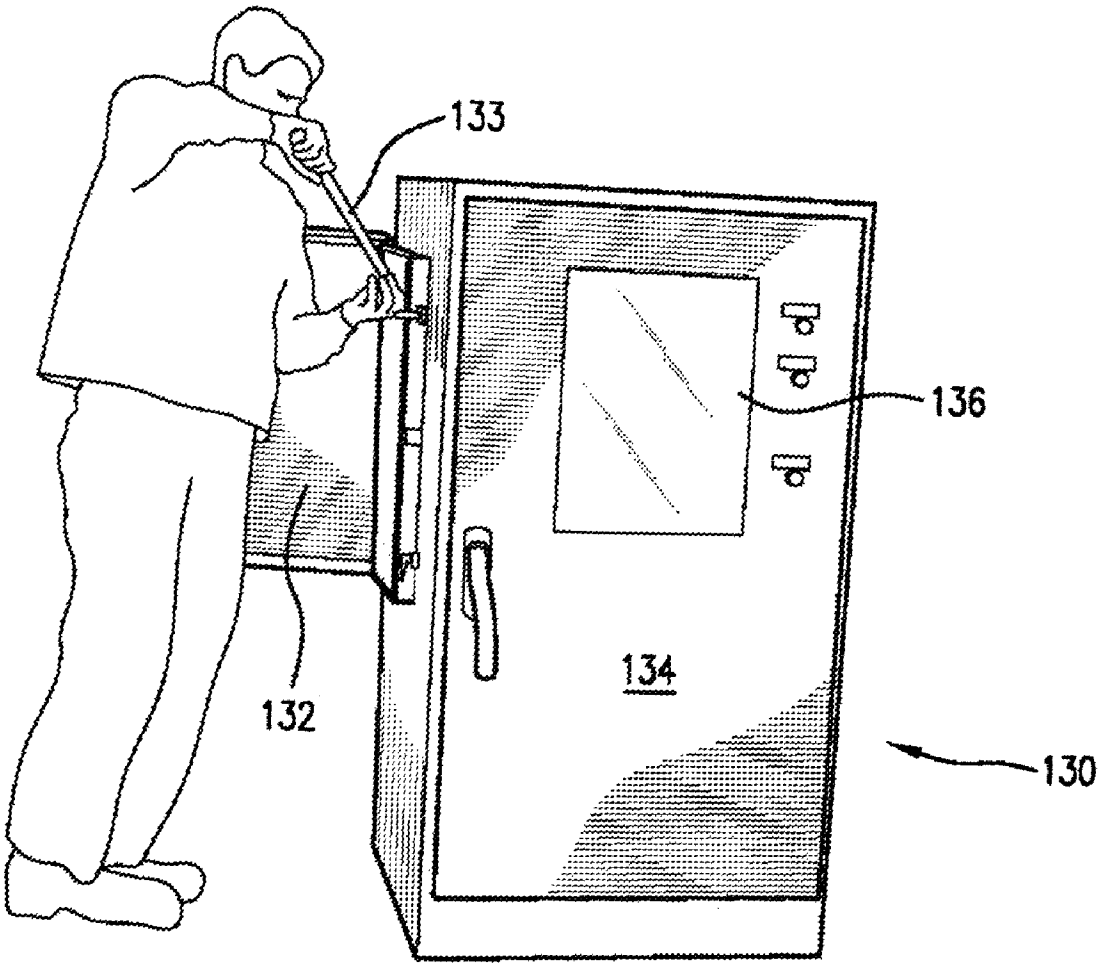
FIG. 3 is a perspective view of an enclosure.

FIG. 3 shows a preferred embodiment of the enclosure of the subject Patent Application. In this embodiment, the enclosure is a cabinet 130 (enclosure and cabinet are used interchangeably herein). The cabinet 130 has a technician door 134 which may optionally provide access to the inner workings of the system without obstructive members. Window 136 is preferably transparent allowing inspection of components and proper operation from a distance. The cabinet 130 also provides a workers' door 132. The workers' door 132 may be used by any worker, or any standard user who has not been trained to the level of a technician. A technician may also use workers' door 132, however, workers' door 132 only provides limited access to the system whereas the technician door 134 provides for substantially unrestricted access to the system. Preferably, workers' door 132 merely provides access to the through holes 52 and 54 to thereby engage shaft 80 (grounding switch) and shaft 90 (main power switch). Preferably, a socket wrench type tool 133 is provided which may be tethered to the inside of the workers' door 132 to allow a user to manipulate the shafts 80 and 90 through the passage-way created by the alignment or registration of the through-holes of the obstructing member 50, outer disk 60, and inner disk 70.

Figure 4:
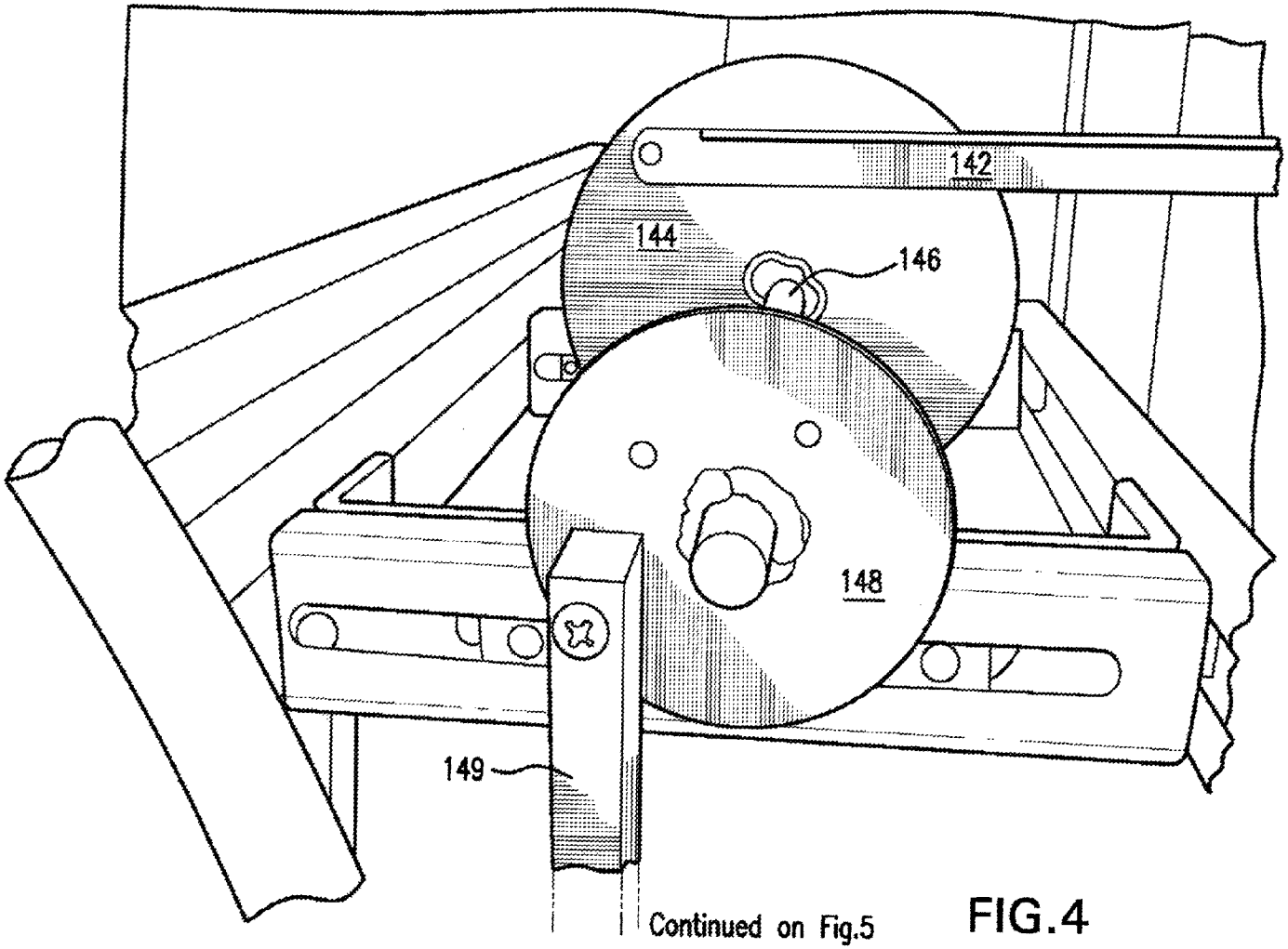
FIGS. 4-5 are perspective views of the receptacle lever locking assembly.

FIG. 4 shows an internal arrangement of the grounding switch interlock. Ground switch linkage 142 couples to the grounding switch on the right most portion and to the large gate wheel 144 pivotally on the left hand side. The large gate wheel 144 is coupled fixedly to the small gate wheel 148 through a coupling member such as a shaft 146. The small gate wheel 148 is pivotally coupled to the ground gate member 149. Thereby, when the grounding switch is deactivated, a leftwards linear motion is imparted on the ground switch linkage 142 which rotates the large gate wheel 144 causing the small gate wheel 148 to rotate in a counterclockwise direction imparting a downward linear motion on the ground gate member 149.

Figure 5:
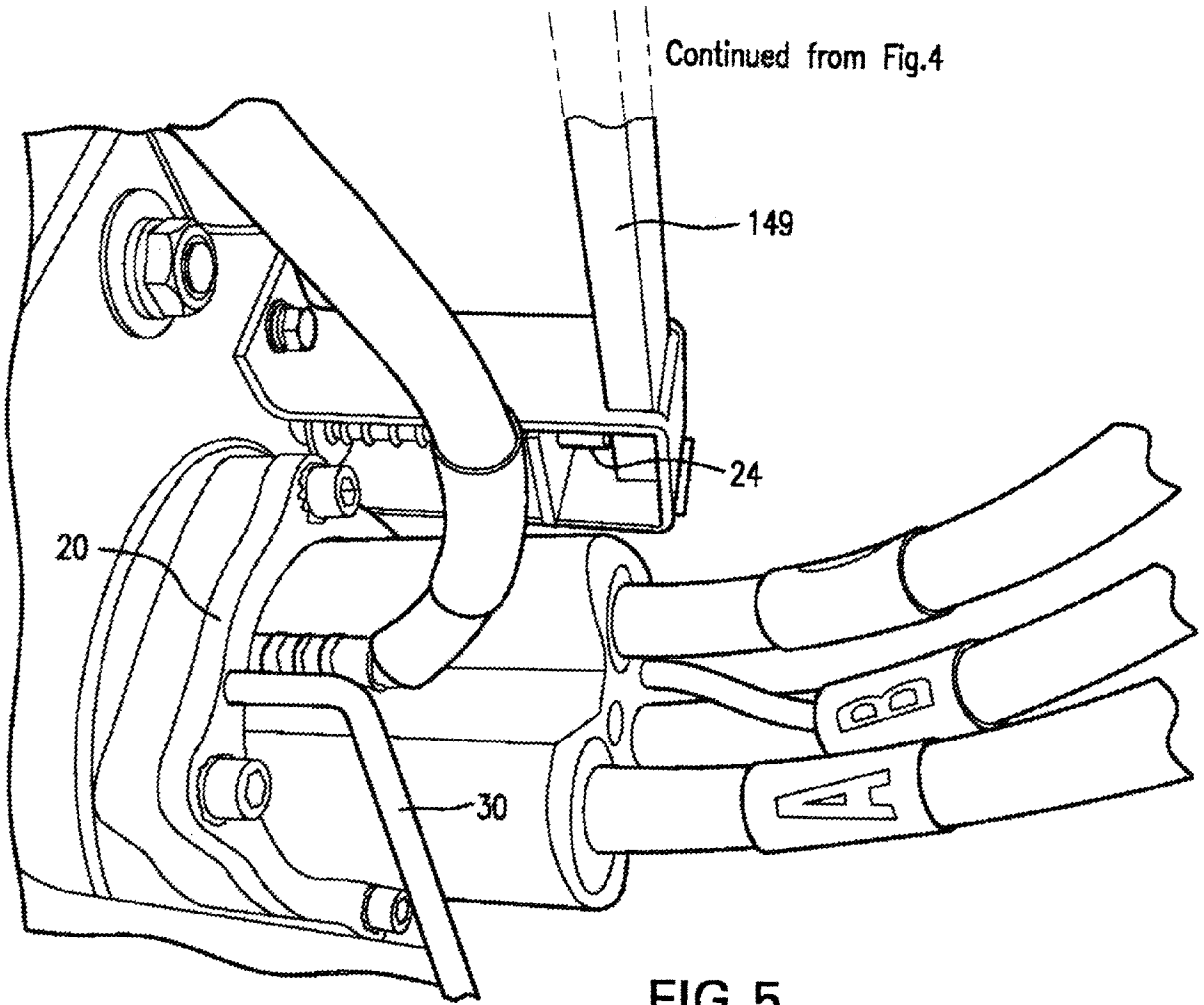

As seen in FIG. 5, the ground gate member 149 is then displaced downwards to restrict travel of the locking pushrod member 24. As seen in FIG. 1 on an outer face of the enclosure 130, the lever handle 22 of the receptacle 20 has a cam-type surface which engages the handle locking pushrod 24. When a user would attempt to unlock the lever handle 22, the cam surface abuts against the locking push rod 24 which is unable to travel further to accommodate the lever handle's 22 cam surface due to the obstructive element ground gate member 149. Thereby, the lever handle 22 is unable to be unlocked until ground gate member 149 has resumed an upwards displacement brought about by the regrounding or the engaging of the grounding switch to the "ON" position. As is also seen in FIG. 5, plug push-rod 30 is disposed through receptacle 20 and is engaged when the plug is inserted into receptacle 20 thereby displacing plug push-rod 30 in a lateral rightward displacement.

Figure 6:
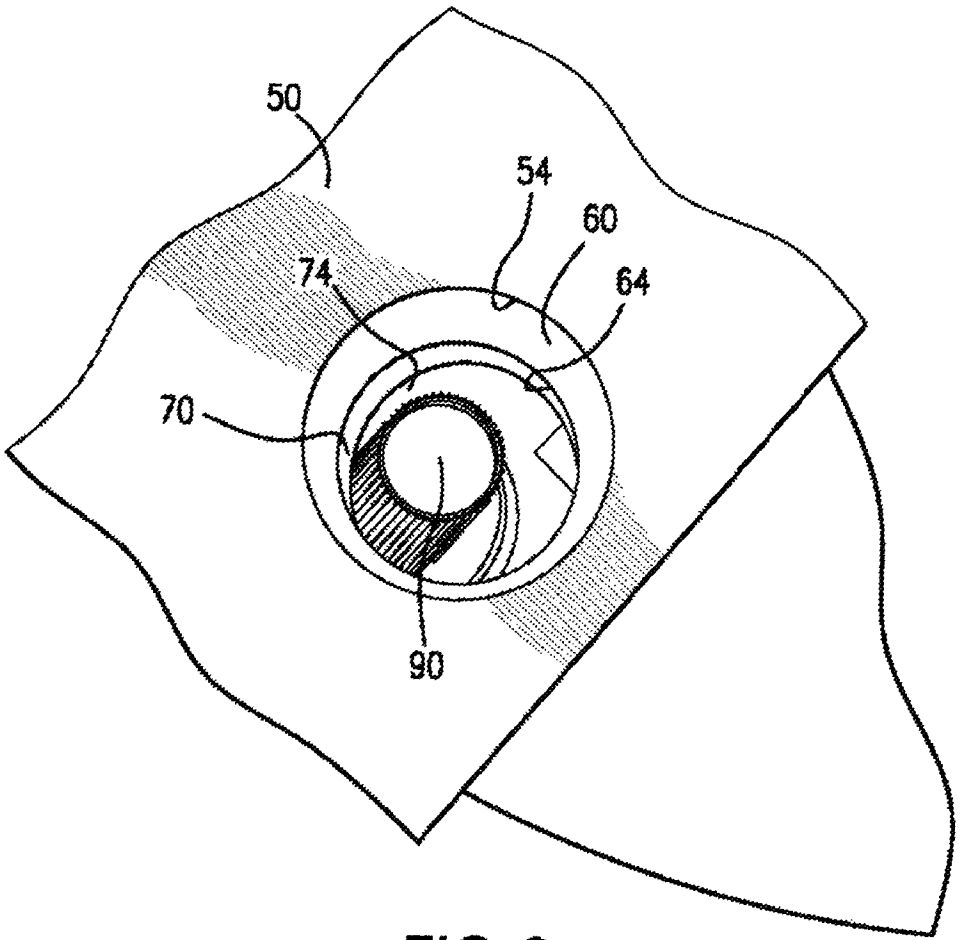
FIG. 6 is a perspective view of the obstructive disks.

As seen in FIG. 6, the main power switch shaft 90 is exposed and available and permitted to be accessed by the user. Outer disk 60 has been rotated such that through-hole 64 of the outer disk 60 has been brought into registration with the through-hole 54 of obstructive element 50. Still further, the inner disk 70 has also been rotated into position such that its through-hole 74 has also been brought into registration with through-hole 64 and 54 thereby allowing access through an unobstructed composite through-hole to main power switch shaft member 90.

Figure 7:
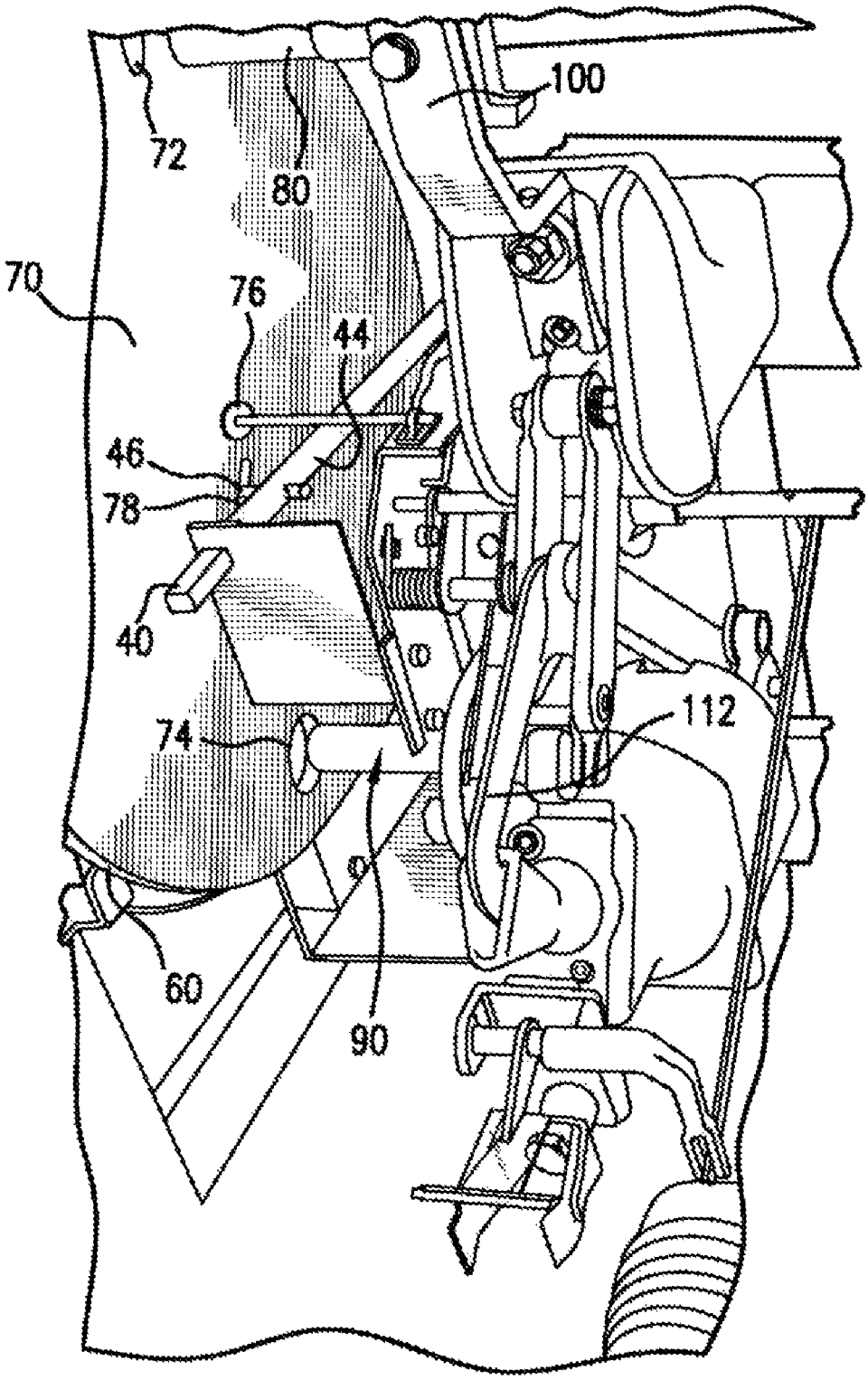
FIG. 7 is a perspective view of the obstructive disks from an internal position of the enclosure.

FIG. 7 shows an internal view of the cabinet 130. Grounding shaft 80 is coupled to the grounding blade 112 which engages with the grounding point 100. As is seen, grounding shaft 80 and main power shaft 90 are exposed through the through-holes 72 and 74. Inner disk 70 is contained on a pivoting rod 76. Receptacle push-rod 40 has a disk engaging portion 44 having a joined perpendicular bit 46 which engages a slot cut through inner disk 70. Thereby, when the lever handle 22 is locked into place on the plug receptacle 20, the push-rod 40 is engaged laterally which imparts a rotational motion to inner disk 70. Inner disk 70 is disposed in parallel arrangement with outer disk 60.

Figure 8:
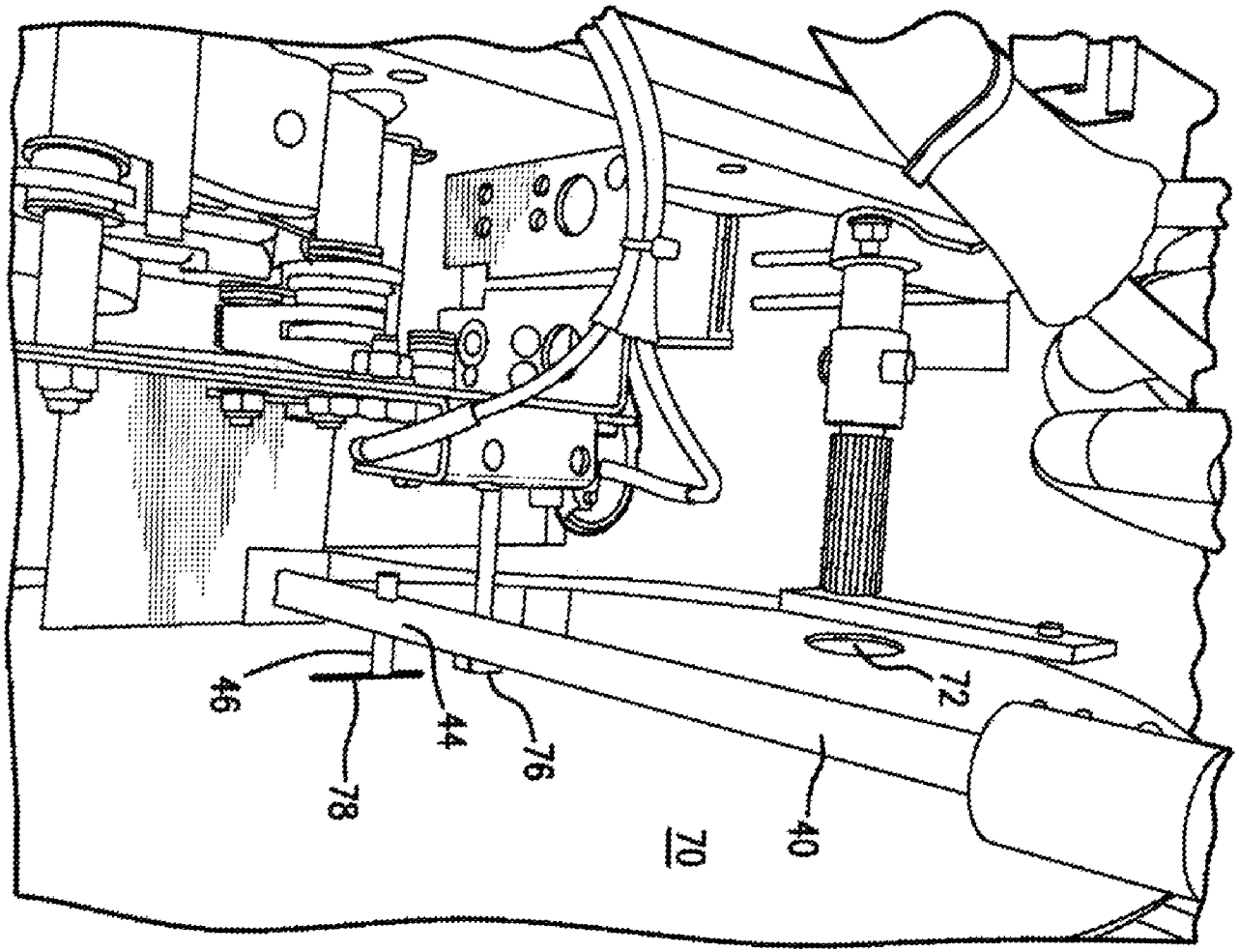
FIG. 8 is a plan view of the internal push rod and obstructive disk assembly.

FIG. 8 shows an alternate view of the receptacle push-rod 40 having a disk engaging portion 44 containing a perpendicular bit 46 which engages a slot 78 of the inner disk 70 to impart a rotational movement responsive to the linear insertion of the plug member. Inner disk 70 is seen to have a pivot point 76 and a first through-hole 72.

Figure 9:
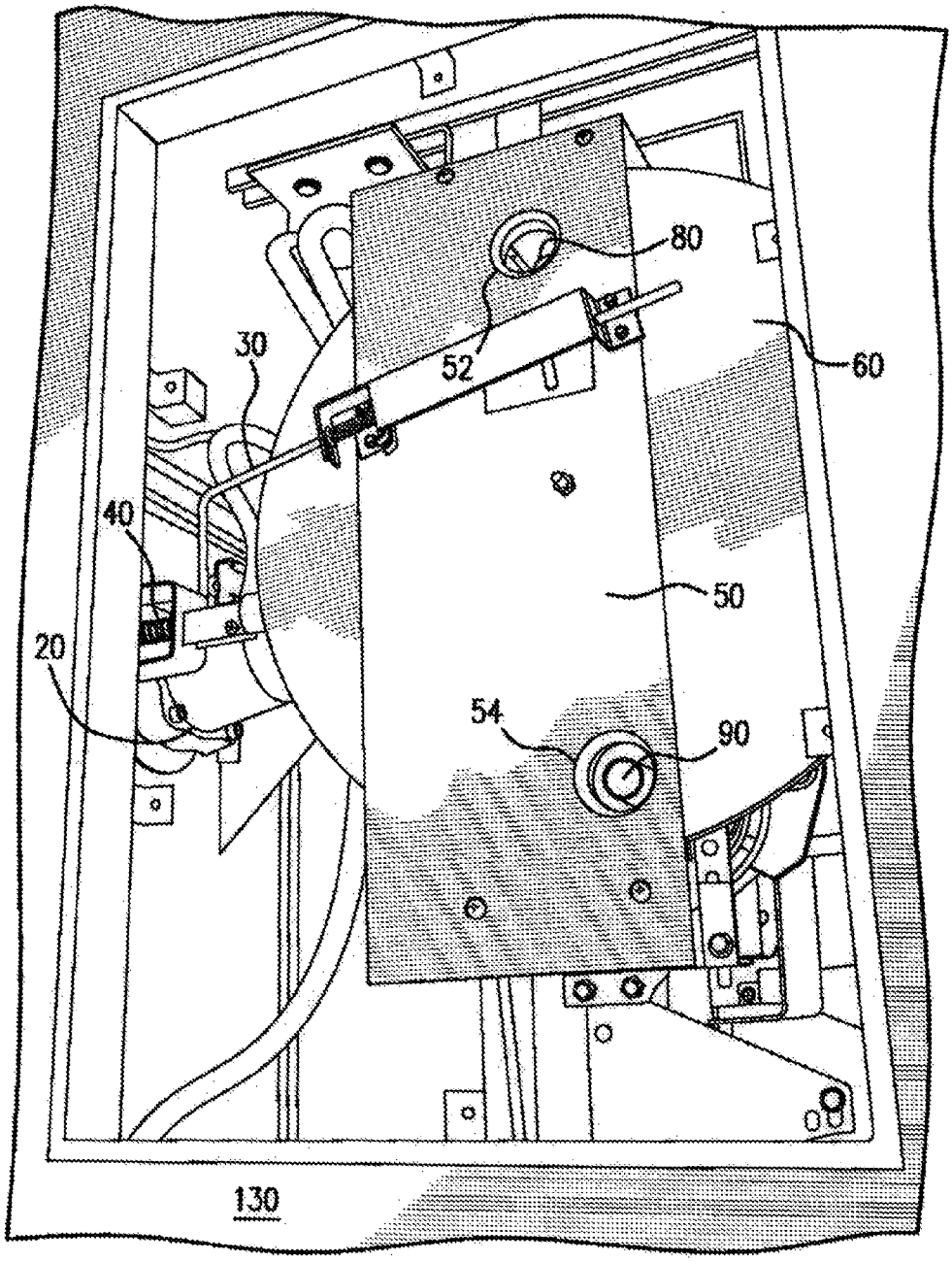
FIG. 9 is a perspective view of the obstructive disks and enclosure.

FIG. 9 is a possible view that a worker or user of this system would see when accessing the workers' door 132. More preferably, obstructive element 50 would expand to occlude view of the disks entirely and all other inner mechanisms, ideally providing solely for through-holes 52 and 54. It is seen that outer disk 60 is rotated such that its through holes are in registration with the obstructive element 50's through holes 52 and 54. Therefore it can be ascertained that a plug has been inserted into receptacle 20 imparting a linear motion on plug push rod 30 which then engages the outer disk 60 imparting the rotational movement to bring the through holes into registration. As shaft members 80 and 90 are visible through the respective through-holes it can also be ascertained that the lever handle 22 of plug receptacle 20 has indeed been locked into a locking position thereby engaging the receptacle push rod 40 to thereby rotate the inner disk 70 thereby resulting in all three respective pairs of through-holes being brought into registration. Cabinet 130 is seen enclosing the remainder of the inner workings.

Figure 10:
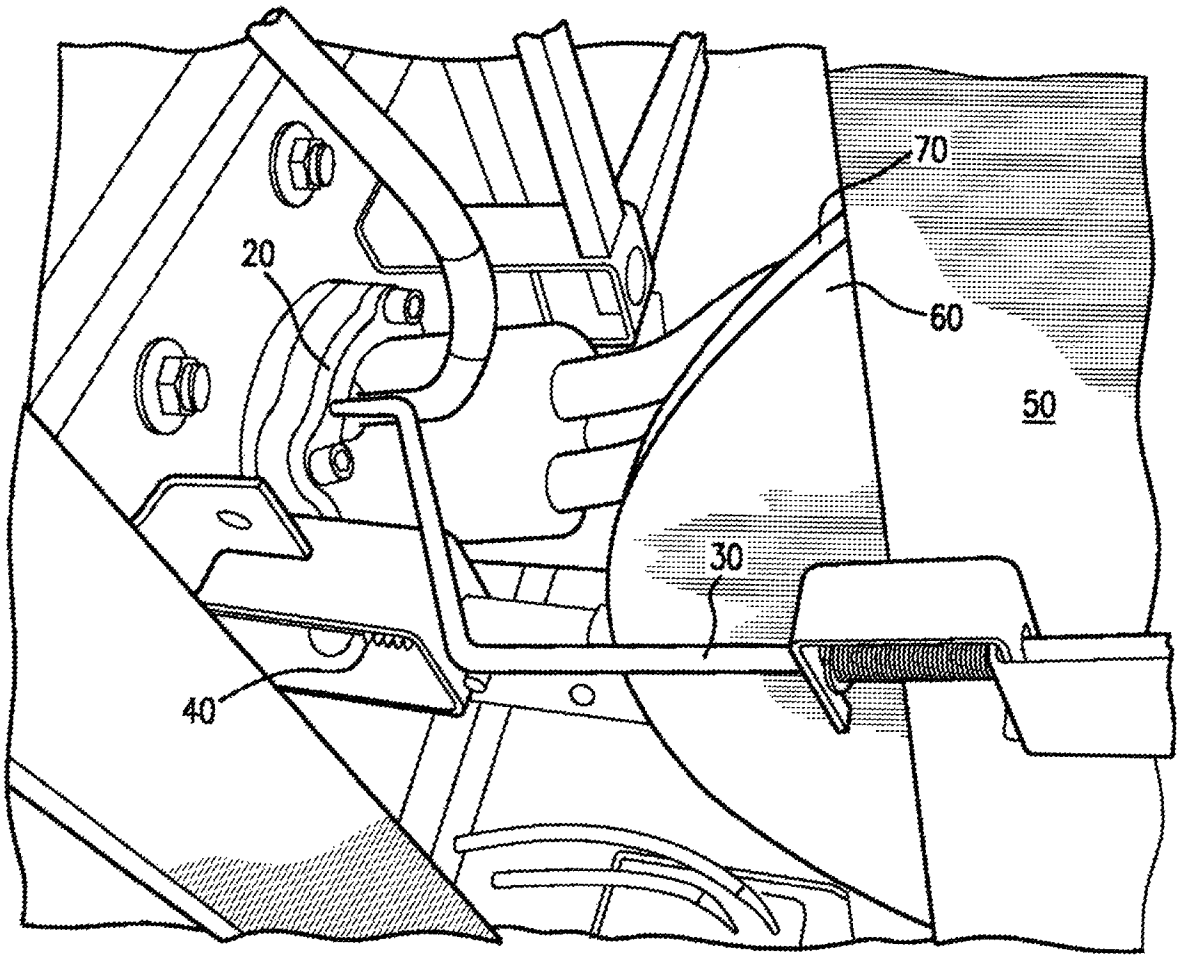
FIG. 10 is a perspective view illustrating the plug push rod coupling to an obstructive disk.

FIG. 10 shows another angle of the plug push-rod 30 being engaged through plug receptacle 20 and thereby rotating the outer disk 60 in relation to the obstructive element 50. Also seen is the relation of receptacle push-rod 40 to the plug push-rod 30.

Figure 11:
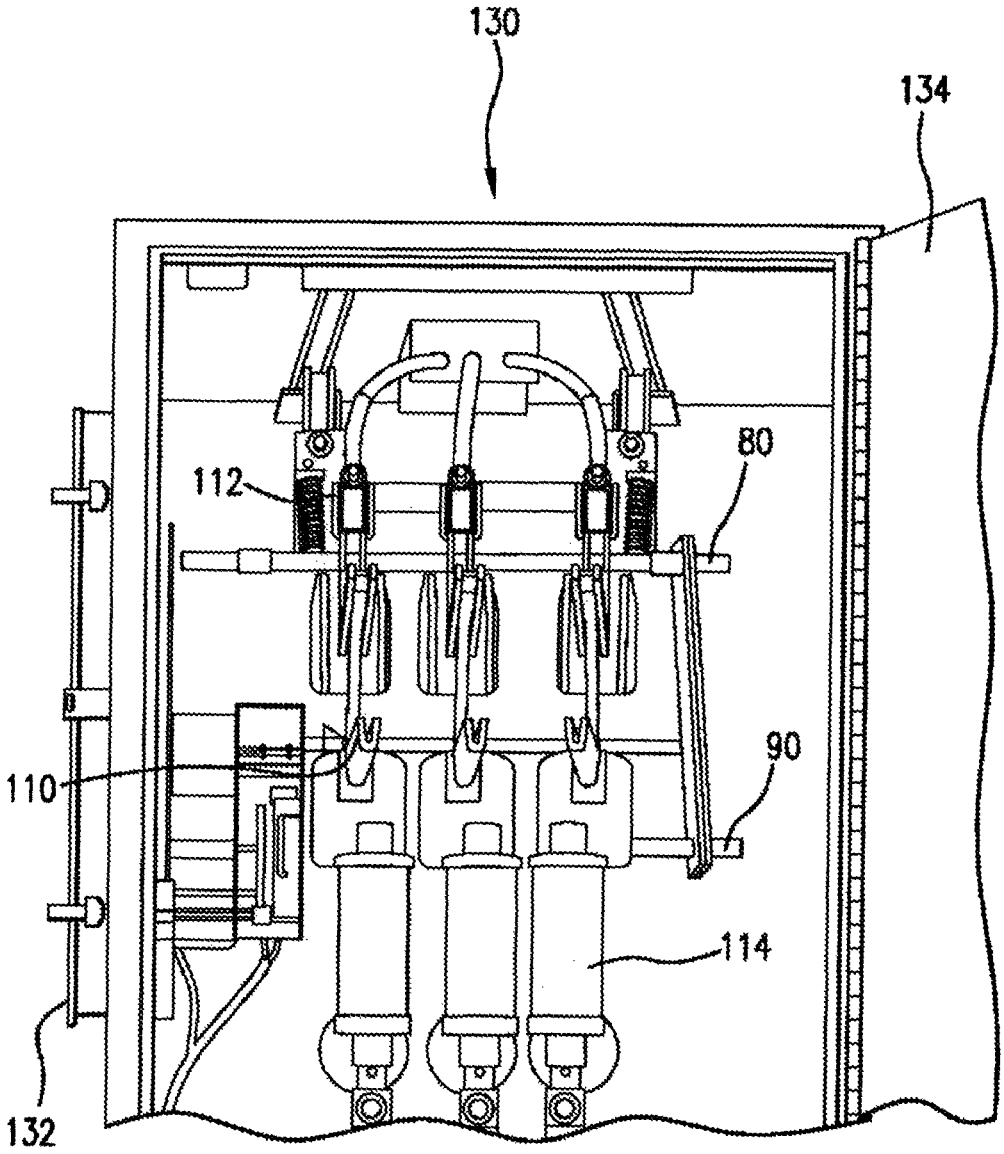
FIG. 11 is an elevational view of the parallel shafts and switch structures.

FIG. 11 shows a view of the enclosure 130 with the technician door 134 open exposing the innards of the system to a qualified/certified electrician/technician. Fuses 114 may be inserted in-line with the main power switch. Grounding shaft

80 is shown in parallel relation to main power switch shaft 90. Grounding blades 112 are shown engaged in the grounded position. Workers' door 132 is shown closed.

Main power contacts 110 and grounding blades 112 could be circuit breakers or molded case switches or any other switch type known to one of skill in the art. Still further, voltage ranges of up to 5.5 kV, 7.2 kV, or higher could be accommodated. Yet further, three phase, neutral plus ground, or three phase plus ground could be accommodated and color coded for easy access, installation, maintenance, and/or removal.

To better withstand adverse conditions, the cabinet 130 may be optionally fabricated from stainless steel or cold rolled steel. To even further prevent corrosion, and withstand adverse environments, a plurality of latches on the side of the cabinet 130 with tightenable screws to exert a further force against the gasketed doors and the cabinet 130 to ensure a sufficient sealing force may optionally be installed.

Still further, optionally, the technician door 134, or even potentially, the workers' door 132 may be locked in a closed position by means known to one of reasonable skill in the art.

Figure 12:
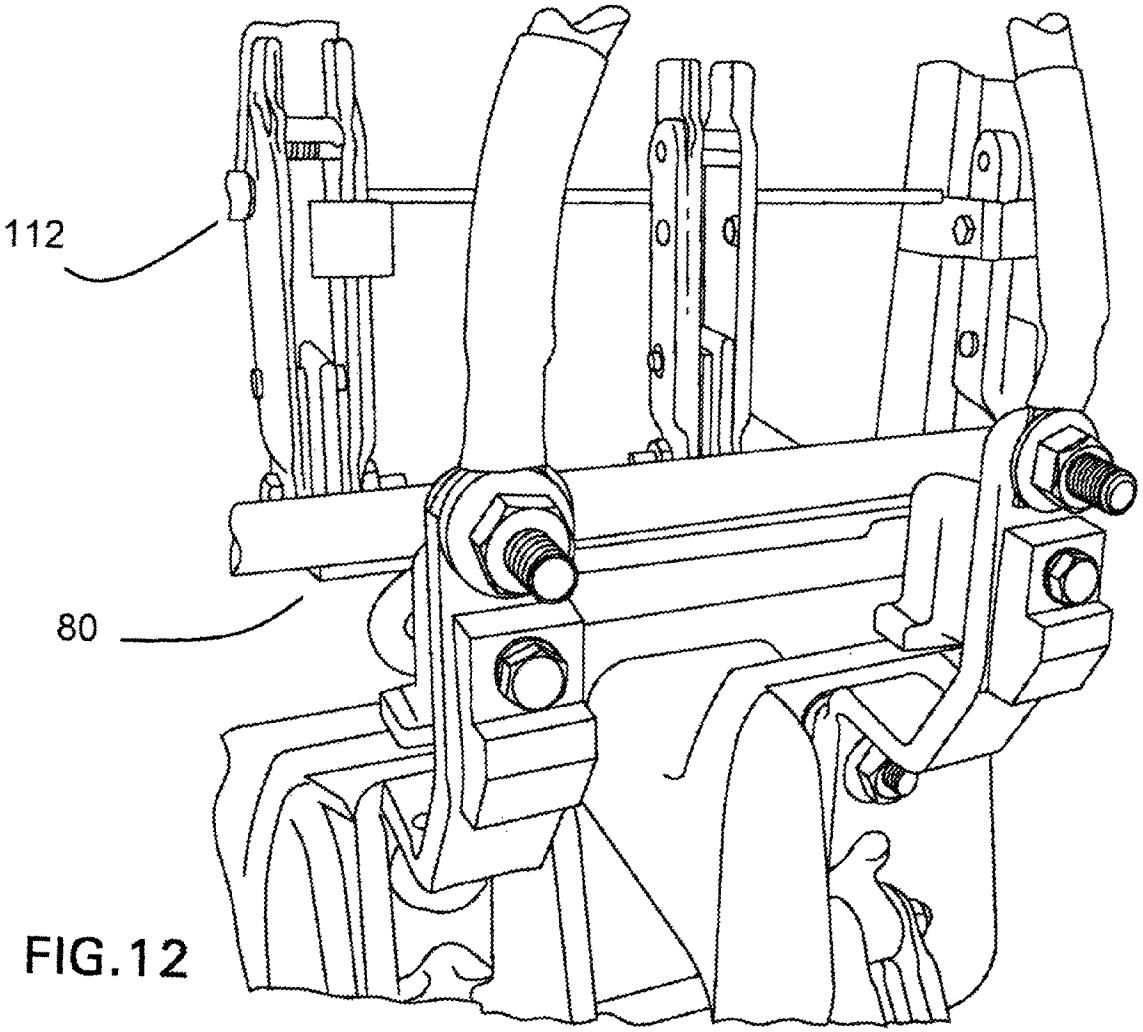
FIG. 12 is a perspective view of the grounding switch blades.

FIG. 12 shows a perspective view of the grounding blades 112 coupled to grounding shaft 80 within enclosure (130 not shown) from the technician door (134 not shown).

Although this invention has been described in connection with specific forms and embodiments thereof, it will be appreciated that various modifications other than those discussed above may be resorted to without departing from the spirit or scope of the invention as defined in the appended claims. For example, equivalent elements may be substituted for those specifically shown and described, certain features may be used independently of other features, and in certain cases, particular applications of elements may be reversed or interposed, all without departing from the spirit or scope of the invention as defined in the appended claims.

What is being claimed:

1. A mechanical interlock of a disconnect box having a plug receptacle with shaft operated switches comprising:

an enclosure defining an interior cavity, said enclosure having a door defined therethrough;

a switch assembly disposed in said recess of said enclosure and including:

a first switch and a second switch;

a first shaft operably coupled with said first switch;

a second shaft disposed in parallel relation to said first shaft and operably coupled with said second switch;

an interlocking power activation bar operably engaged by one of the first shaft and the second shaft, whereby rotation of one of said shafts to an "on" position displaces said interlocking power activation bar transversely to lock the other of said shafts from rotating to an "on" position, thereby preventing both of said shafts from being rotated to an "on" position concurrently;

a plug receptacle disposed through a wall of said enclosure, said plug receptacle having a plug receptacle handle;

a first disk and a second disk disposed between said door and said cavity of said enclosure to initially occlude said first and second shafts while no plug has been inserted into said plug receptacle, each of said first disk and said second disk having two through-holes defined therethrough;

a first pushrod, said first pushrod having a portion protruding into said plug receptacle and slidingly coupled between said plug receptacle and an off-center portion of said first disk, wherein said first pushrod actuates said first disk rotationally responsive to a plug insertion into said plug receptacle impinging on said protruding portion of said first pushrod;

a second pushrod, said second pushrod slidingly coupled between said plug receptacle handle and an off-center portion of said second disk, wherein said second pushrod rotates said second disk responsive to said plug receptacle handle being actuated into a plug locking position, whereby said through-holes of said first disk and said second disk are brought into registration with said two shafts to thereby allow actuation of either of said two shafts; and, a plug receptacle handle locking member including:

a third pushrod operably coupled between a cam of said plug receptacle handle and said first shaft, said third pushrod being immobilized to prevent actuation of said plug receptacle handle, said third pushrod engaging said plug receptacle handle responsive to said first shaft being rotated to an "off" position, whereby a plug is mechanically interlocked from removal while said first shaft is in an "off" position.

2. The mechanical interlock of a disconnect box having a plug receptacle with shaft operated switches as defined in claim 1, wherein said enclosure is a cabinet.

3. The mechanical interlock of a disconnect box having a plug receptacle with shaft operated switches as defined in claim 1 further comprising:

a large gate wheel;

a ground switch linkage operably coupled to said first shaft and said large gate wheel;

a small gate wheel coupled to said large gate wheel; and, a ground gate member pivotally coupled to said small gate wheel, wherein said ground gate member is selectively brought into the path of said third pushrod to inelastically restrict said third pushrods travel to lock said plug receptacle handle from actuation responsive to said first shaft being rotated to an "off" position.

4. The mechanical interlock of a disconnect box having a plug receptacle with shaft operated switches as defined in claim 3 wherein said first shaft is coupled to a grounding switch.

5. The mechanical interlock of a disconnect box having a plug receptacle with shaft operated switches as defined in claim 1 wherein said door being opened signals a feeder breaker to effect an upstream disconnection.

6. The mechanical interlock of a disconnect box having a plug receptacle with shaft operated switches as defined in claim 1 further comprising a second door, said second door providing substantially unobstructed access to said switches.

7. The mechanical interlock of a disconnect box having a plug receptacle with shaft operated switches as defined in claim 6 further comprising a window defined in said second door, a physical indicia of a grounding status being visible through said window.

8. The mechanical interlock of a disconnect box having a plug receptacle with shaft operated switches as defined in claim 1 wherein said plug receptacle accepts a push-pull type connector.

9. A mechanical interlock of a disconnect box having a plug receptacle with shaft operated switches comprising:

an enclosure defining an interior cavity, said enclosure having a door defined therethrough;

a switch assembly disposed in said recess of said enclosure and including:

a first switch and a second switch;

a first shaft operably coupled with said first switch;

a second shaft disposed in parallel relation to said first shaft and operably coupled with said second switch;

an interlocking power activation bar operably engaged by one of the first shaft and the second shaft, said interlocking power activation bar operable to prevent both of said shafts from being rotated to an "on" position concurrently;

a plug receptacle disposed through a wall of said enclosure;

a first disk disposed between said door and said cavity of said enclosure to initially occlude said first and second shafts while no plug has been inserted into said plug receptacle, said first disk having two through-holes defined therethrough; and, a first pushrod, said first pushrod having a portion protruding into said plug receptacle and slidingly coupled between said plug receptacle and said first disk, wherein said first pushrod actuates said first disk rotationally responsive to a plug insertion into said plug receptacle, whereby said through-holes of said first disk are brought into registration with said two shafts to thereby allow actuation of either of said two shafts.

10. The mechanical interlock of a disconnect box having a plug receptacle with shaft operated switches as defined in claim 9 further comprising:

a plug receptacle handle;

a second disk disposed in parallel relation to said first disk, said second disk having through-holes; and, a second pushrod, said second pushrod operably coupled in sliding relation between said plug receptacle handle and said second disk, wherein said second pushrod rotates said second disk responsive to said plug receptacle handle being actuated into a plug locking position.

11. The mechanical interlock of a disconnect box having a plug receptacle with shaft operated switches as defined in claim 10 further comprising:

a third pushrod operably coupled between a cam of said plug receptacle handle and said first shaft, said third pushrod being immobilized to prevent actuation of said plug receptacle handle, said third pushrod engaging said plug receptacle handle responsive to said first shaft being rotated to an "off" position, whereby a plug is mechanically interlocked from removal while said first shaft is in an "off" position.

12. The mechanical interlock of a disconnect box having a plug receptacle with shaft operated switches as defined in claim 11 further comprising:

a ground switch linkage operably coupled to said first shaft;

a large gate wheel;

a small gate wheel coupled to said large gate wheel; and, a ground gate member pivotally coupled to said small gate wheel, wherein said ground gate member is selectively brought into the path of said third pushrod to inelastically restrict said third pushrods travel to lock said plug receptacle handle from actuation responsive to said first shaft being rotated to an "off" position.

13. The mechanical interlock of a disconnect box having a plug receptacle with shaft operated switches as defined in claim 10 wherein said enclosure is a cabinet.

14. The mechanical interlock of a disconnect box having a plug receptacle with shaft operated switches as defined in claim 10 wherein said first shaft is operably coupled to a grounding switch.

15. The mechanical interlock of a disconnect box having a plug receptacle with shaft operated switches as defined in claim 10 wherein said door being opened signals a feeder breaker to effect an upstream disconnection.

16. The mechanical interlock of a disconnect box having a plug receptacle with shaft operated switches as defined in claim 10 further comprising a second door, said second door providing substantially unobstructed access to said switches.

17. The mechanical interlock of a disconnect box having a plug receptacle with shaft operated switches as defined in claim 16 further comprising a window defined in said second door, a physical indicia of a grounding status being visible through said window.

18. The mechanical interlock of a disconnect box having a plug receptacle with shall operated switches as defined in claim 10 wherein said plug receptacle accepts a push-pull type connector.

19. A mechanical interlock of a disconnect box having a plug receptacle with shaft operated switches comprising:

a plug receptacle having a locking handle lever;

a first shaft and a second shaft disposed in parallel relation, each of said first shaft and said second shaft having an end portion;

a planar obstructive assembly initially disposed obstructively to said end portions of each of said first and second shafts, said planar obstructive assembly having a through-hole defined therethrough;

a first pushrod, said first pushrod being slidingly coupled between said plug receptacle and said planar obstructive assembly, wherein said first pushrod displaces said planar obstructive assembly responsive to a plug insertion into said plug receptacle; and, a second pushrod, said second pushrod being operably coupled in sliding relation between said locking handle lever of said plug receptacle and said obstructive planar assembly, wherein said second pushrod further displaces said obstructive planar assembly responsive to said plug receptacle being locked, whereby said through-hole of said planar obstructive assembly is brought into registration with said end portions of said first shaft and said second shaft to thereby allow actuation of either of said first shaft or said second shaft therethrough.

20. The mechanical interlock of a disconnect box having a plug receptacle with shaft operated switches as defined in claim 19 wherein said planar obstructive assembly comprises two planar obstructive members.

* * * * *